US010094211B2

(12) United States Patent
Parkin

(10) Patent No.: US 10,094,211 B2
(45) Date of Patent: Oct. 9, 2018

(54) METHODS FOR ESTIMATING WELLBORE GAUGE AND DOGLEG SEVERITY

(71) Applicant: Schlumberger Technology Corporation, Sugar land, TX (US)

(72) Inventor: Edward Parkin, Cheltenham (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 816 days.

(21) Appl. No.: 14/511,090

(22) Filed: Oct. 9, 2014

(65) Prior Publication Data

US 2016/0102543 A1 Apr. 14, 2016

(51) Int. Cl.

| | |
|---|---|
| ***E21B 47/024*** | (2006.01) |
| ***E21B 7/06*** | (2006.01) |
| ***E21B 17/05*** | (2006.01) |
| ***E21B 17/10*** | (2006.01) |
| ***E21B 47/022*** | (2012.01) |
| ***E21B 47/08*** | (2012.01) |

(52) U.S. Cl.

CPC ..... *E21B 47/024* (2013.01); *E21B 7/06* (2013.01); *E21B 17/05* (2013.01); *E21B 17/10* (2013.01); *E21B 47/022* (2013.01); *E21B 47/08* (2013.01)

(58) Field of Classification Search

None

See application file for complete search history.

(56) References Cited

U.S. PATENT DOCUMENTS

| | | | | |
|---|---|---|---|---|
| 6,882,937 | B2 | 4/2005 | McElhinney | |
| 6,985,814 | B2 | 1/2006 | McElhinney | |
| 7,188,685 | B2 | 3/2007 | Downton et al. | |
| 7,243,719 | B2 | 7/2007 | Baron et al. | |
| 7,260,477 | B2 | 8/2007 | Haugland | |
| 7,584,788 | B2 | 9/2009 | Baron et al. | |
| 7,725,263 | B2 | 5/2010 | Sugiura | |
| 8,118,114 | B2 | 2/2012 | Sugiura | |
| 8,579,044 | B2 | 11/2013 | Allen et al. | |
| 2006/0065401 | A1* | 3/2006 | Allen | E21B 44/00 166/345 |
| 2006/0157278 | A1* | 7/2006 | Dolgin | E21B 47/022 175/45 |
| 2008/0149394 | A1* | 6/2008 | Downton | E21B 17/1014 175/73 |
| 2009/0000823 | A1* | 1/2009 | Pirovolou | E21B 7/04 175/61 |

* cited by examiner

*Primary Examiner* — John Kuan

(57) ABSTRACT

Methods for measuring wellbore gauge and dogleg severity are disclosed. The methods include deploying a downhole tool in a subterranean wellbore. The downhole tool includes first and second axially spaced stabilizers deployed on at least one tool body section coupled to a universal joint. The method for measuring wellbore gauge further includes measuring first and second axial directions of the tool body section when the universal joint is tilted in corresponding first and second cross-axial directions and processing the first and second measured axial directions to estimate the wellbore gauge. The method for measuring dogleg severity further includes measuring first and second tilt angles of the universal joint when the universal joint is tilted in corresponding first and second cross-axial directions and then processing the first and second measured tilt angles to estimate the dogleg severity.

20 Claims, 4 Drawing Sheets

METHODS FOR ESTIMATING WELLBORE GAUGE AND DOGLEG SEVERITY

CROSS REFERENCE TO RELATED APPLICATIONS

None.

FIELD OF THE INVENTION

Disclosed embodiments relate generally to methods for measuring properties of a subterranean wellbore while drilling and more particularly to methods for measuring wellbore gauge and/or dogleg severity while drilling.

BACKGROUND INFORMATION

The use of automated drilling methods is becoming increasingly common in drilling subterranean wellbores. Such methods may be employed, for example, to control the direction of drilling based on various downhole feedback measurements, such as inclination and azimuth measurements made while drilling or logging while drilling measurements.

These automated methods may be enhanced by measurements of various wellbore properties while drilling. For example, certain automated drilling models make use of the dogleg severity of the wellbore. Moreover, certain logging while drilling measurements can be influenced by the standoff distance between the logging sensor and the borehole wall. The standoff distance tends to be related at least in part to the gauge (the cross sectional diameter) of the wellbore.

While methods exist for measuring dogleg severity and wellbore gauge there is room for further improvement and for the use of redundant measurement techniques.

SUMMARY

Methods for measuring wellbore gauge and dogleg severity are disclosed. A method for estimating wellbore gauge includes deploying a downhole tool in a subterranean wellbore. The downhole tool includes first and second axially spaced stabilizers deployed on at least one tool body section coupled to a universal joint (e.g., on corresponding first and second tool body sections coupled to one another at the universal joint). A first axial direction of the tool body section is measured when the universal joint is tilted in a first cross-axial direction and a second axial direction of the tool body section is measured when the universal joint is tilted in a second cross-axial direction. The first axial and second axial directions are then processed to estimate the wellbore gauge.

A method for estimating dogleg severity includes deploying a downhole tool in a subterranean wellbore. As described above, the downhole tool includes first and second axially spaced stabilizers deployed on at least one tool body section coupled to a universal joint. A first tilt angle of the universal joint is measured when the universal joint is tilted in a first cross-axial direction and a second tilt angle of the universal joint is measured when the universal joint is tilted in a second cross-axial direction. The first and second measured tilt angles are then processed to estimate the dogleg severity.

The disclosed embodiments may provide various technical advantages. For example, the diameter and dogleg severity of a subterranean wellbore may be measured while drilling or reaming. These measurements may be used in real time while drilling in automated drilling models or in the interpretation of various logging while drilling data.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
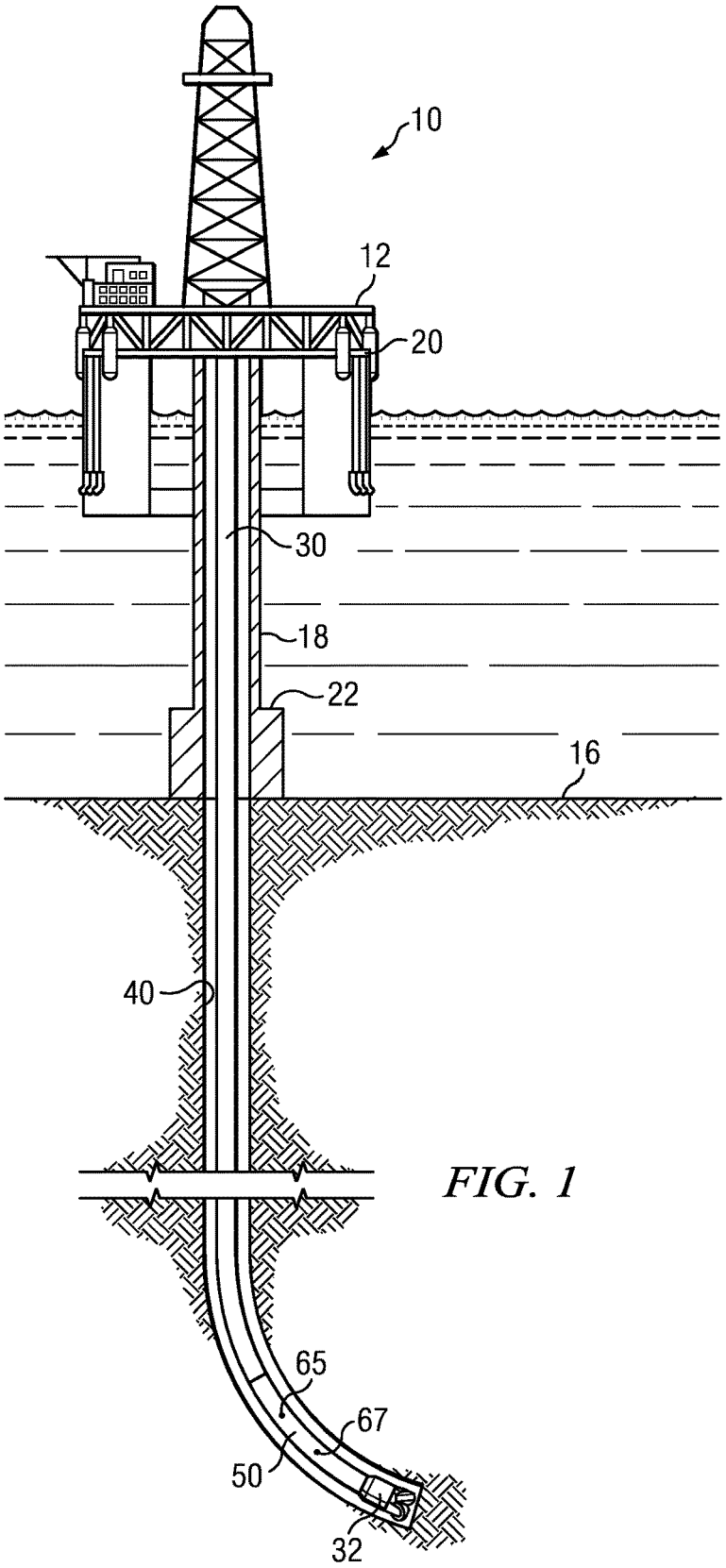
FIG. 1 depicts one example of a drilling rig on which disclosed methods may be utilized.

FIG. 1 depicts a drilling rig 10 suitable for using various method embodiments disclosed herein. A semisubmersible drilling platform 12 is positioned over an oil or gas formation (not shown) disposed below the sea floor 16. A subsea conduit 18 extends from deck 20 of platform 12 to a wellhead installation 22. The platform may include a derrick and a hoisting apparatus for raising and lowering a drill string 30, which, as shown, extends into wellbore 40 and includes a drill bit 32 and a downhole tool 50 (such as a rotary steerable tool) having downhole sensors 65 and 67 (which are described in more detail below with respect to FIG. 2).

Drill string 30 may further include substantially any other suitable downhole tools, for example, including a downhole drilling motor, a steering tool, a downhole telemetry system, and one or more MWD or LWD tools including various sensors for sensing downhole characteristics of the wellbore and the surrounding formation. The disclosed embodiments are not limited in these regards. While FIG. 1 depicts an offshore drilling rig 20, it will be understood that the disclosed embodiments are not so limited and may be used in both onshore and offshore operations.

Figure 2:
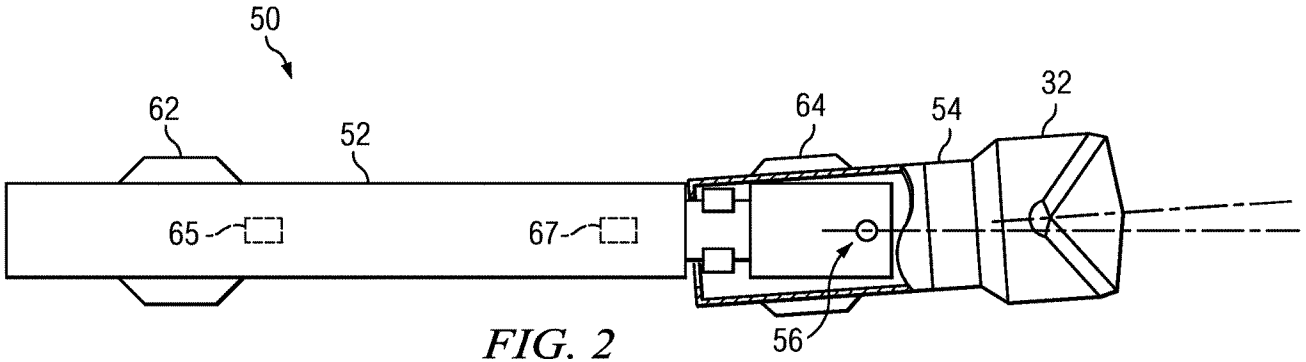
FIG. 2 depicts one example of a rotary steerable tool that may be used to practice the disclosed methods.

FIG. 2 depicts one example of the downhole tool 50 shown on FIG. 1. Downhole tool 50 may include a rotary steerable tool, for example, such as the PowerDrive Archer® available from Schlumberger Technology Corporation. One suitable embodiment is disclosed in U.S. Pat. No. 7,188,685, which is incorporated by reference herein in its entirety.

As depicted on FIG. 2, tool 50 includes first and second, upper and lower tool body sections 52 and 54 coupled to one another at a universal joint 56. The universal joint 56 may include, for example, a two-degree of freedom universal joint that allows for rotation of the periphery of the steering section around its axis, a variable offset angle, and also torque transfer. In the depicted embodiment a first upper stabilizer 62 is deployed on the upper tool body section 52 and a second lower stabilizer 64 is deployed on the lower tool body section 54. It will be understood that the first and second upper and lower stabilizers 62 and 64 may alternatively both be deployed on the upper tool body section 52. It will be understood that the first and second stabilizers 62 and 64 do not necessarily have the same diameter and may be slightly under-gauge (e.g., about one eighth of an inch) as compared to the drill bit.

The tool 50 may further include one or more motors or pistons (not shown) configured to actively tilt the lower tool body section 54 about the universal joint 56 with respect to the upper tool body section 52. For example, pistons acting on the periphery of the lower tool body section 54 may be employed to tilt the lower tool body section 54 (and the drill bit 32 connected thereto) with respect to the upper tool body section 52. In rotary steerable embodiments, such pistons may be sequentially actuated while rotating the drill string such that the tilt of the drill bit is actively maintained in the desired direction (toolface) with respect to the formation being drilled.

Downhole tool 50 may further include upper and lower sensor sets 65 and 67 deployed therein. For example, the upper sensor set 65 may include conventional directional (survey) sensors including tri-axial accelerometers and tri-axial magnetometers. Such sensor sets are well known in the art for measuring wellbore attitude (e.g., including wellbore inclination and wellbore azimuth) and thus need not be described in further detail. The lower sensor set 67 may include sensors, for example, including strain gauges, for measuring the angular offset (the tilt) of the lower tool body section 54 with respect to the upper tool body section 52. It will be understood that the lower sensor set 67 is not limited to the use of strain gauges and may alternatively include, for example, sensors (such as Hall Effect sensors) which measure a distance between an upper end of the lower tool body section 54 and the upper tool body section 52 from which the tilt angle may be computed. As described in more detail below, measurements made using these sensors 65 and 67 may be processed to compute the wellbore gauge and the dogleg severity.

It will be understood that the disclosed embodiments are not limited to use on a steering tool or a rotary steerable tool (such as is depicted on FIG. 2). Substantially any downhole tool (or combination of tools) including first and second, upper and lower stabilizers deployed on corresponding first and second, upper and lower tool body sections that are configured to tilt (or be tilted) with respect to one another about a swivel or a universal joint may enable measurement of the wellbore gauge and/or dogleg severity in accordance with the disclosed embodiments.

Figure 3:
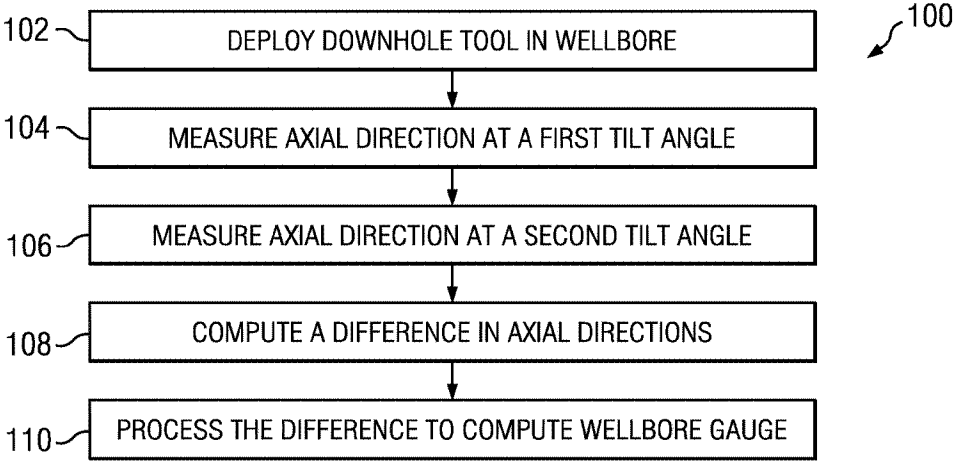
FIG. 3 depicts a flow chart of one example method embodiment for measuring wellbore gauge.

FIG. 3 depicts a flow chart of one disclosed method embodiment 100 for estimating wellbore gauge. The method includes deploying a downhole tool (or tools) (e.g., downhole tool 50) in a subterranean wellbore at 102. As described above with respect to FIG. 2, the downhole tool may include upper and lower stabilizers deployed on corresponding upper and lower tool body sections. The upper and lower tool body sections are coupled to one another via a universal joint that enables relative tilting of the tool body sections (e.g., the lower tool body section may tilt or be actively tilted with respect to the upper tool body section). The axial direction (e.g., the inclination and azimuth) of the upper tool body section is measured when the universal joint is tilted to a first cross-axial angular position (i.e., in a first toolface direction) at 104. For example, the lower tool body section may be tilted towards a first toolface direction such as high side, low side, left side, or right side of the wellbore with respect to the upper tool body section). The axial direction is then measured at 106 when the universal joint is tilted to a second cross-axial angular position (e.g., when the lower tool body section is tilted towards a toolface angle 180 degrees offset from the first angular position in 104). These axial directions may be measured for example using conventional wellbore inclination and wellbore azimuth measurements (e.g., using conventional accelerometer and magnetometer measurements). The axial directions are then processed at 108 to compute a difference between the two (i.e., a change in axial direction) which is in turn processed at 110 to compute the wellbore gauge.

Figure 4:
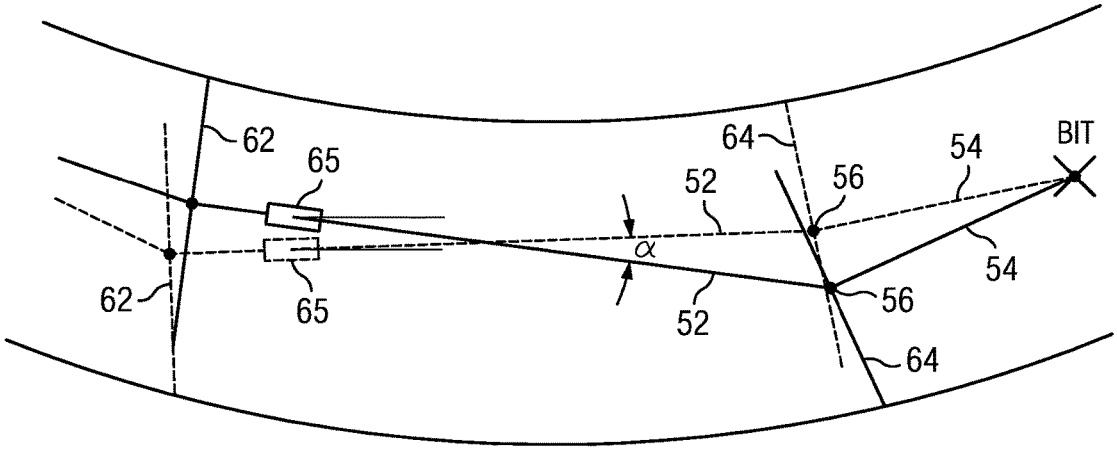
FIG. 4 depicts a schematic of a downhole tool deployed in a deviated wellbore suitable for implementing the method depicted on FIG. 3.

FIG. 4 depicts a schematic of a downhole tool deployed in a deviated wellbore suitable for implementing the method depicted on FIG. 3. It will be understood that the depiction on FIG. 4 is highly schematized and not drawn to scale. For example, the upper and lower stabilizers 62 and 64 and upper and lower tool body sections 52 and 54 are depicted as stick figures in wellbore 40. Moreover, the dogleg severity (curvature) of wellbore 40 is highly exaggerated for illustration purposes. The solid lined depiction shows the tool when the tilt angle is rotated to a first toolface angle (at 104) in the direction of the wellbore curvature and the dashed line depiction shows the tool when the tilt angle is rotated to a second toolface angle (at 106) opposed to the wellbore curvature (180 degrees offset from the wellbore curvature).

With continued reference to FIG. 4, tilting the lower tool body section 54 with respect to the upper tool body section 52 may cause the upper and lower stabilizers 62 and 64 to contact the wellbore wall on the opposite sides of the wellbore. As the tilt angle rotates around the wellbore (e.g., via rotating the force direction in the pistons), the contact points of the upper and lower stabilizers also rotate around the wellbore (yet continue to contact the wellbore wall on opposite sides of the wellbore). In the solid line depiction the upper stabilizer contacts the wellbore on an inside wall of the curved section and the lower stabilizer contacts the wellbore on an outside wall of the curved section. In the dashed line depiction, the upper stabilizer contacts the wellbore on an outside wall of the curved section and the lower stabilizer contacts the wellbore on an inside wall of the curved section.

Rotation of the stabilizer contact points about the wellbore causes a corresponding change in the axial direction of the upper tool body section 52 (this change in axial direction is denoted as a in FIG. 4). In general, the larger the wellbore gauge as compared to the average gauge of the stabilizers, the larger the absolute change in the axial direction of the upper tool body section 52 (i.e., a generally increases with increasing wellbore gauge for a particular tool configuration). The wellbore gauge may be expressed mathematically, for example, as follows:

$$\phi_{Hole} = \frac{L \cdot \sin\alpha + \phi_{Stab1} + \phi_{Stab2}}{2} \tag{1}$$

where $\varnothing_{Hole}$ represents the wellbore gauge (the wellbore diameter), L represents the axial separation distance between the upper and lower stabilizers, $\alpha$ represents the change in axial direction described above, $\varnothing_{Stab1}$ represents the gauge (diameter) of the first stabilizer, and $Ø_{Stab2}$ represents the gauge of the second stabilizer.

In certain operations, rotation of the tilt angle may not cause the upper stabilizer 62 to rotate about the wellbore (as depicted on FIG. 4). For example, in a high dogleg section there may be sufficient bending moment in the upper tool body section 52 (depending on the stiffness of the BHA) such that the upper stabilizer may be constrained to remain on the outside of the curve. In such embodiments, Equation 1 may be simplified as follows:

$$Ø_{Hole}=L\cdot\sin\alpha+Ø_{Stab1} \tag{2}$$

Figure 5:
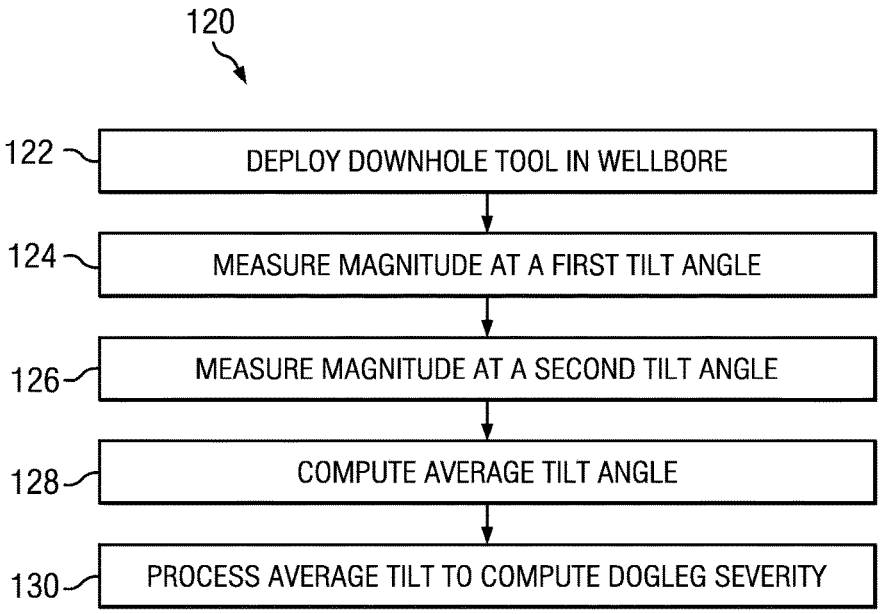
FIG. 5 depicts a flow chart of one example method embodiment for measuring dogleg severity.

FIG. 5 depicts a flow chart of one example method embodiment 120 for measuring dogleg severity. The method includes deploying a downhole tool (or tools) (e.g., downhole tool 50) in a subterranean wellbore at 122. As described above, the downhole tool may include upper and lower stabilizers deployed on corresponding upper and lower tool body sections. The upper and lower tool body sections are coupled to one another via a universal joint that enables the lower tool body section to tilt (or be tilted) with respect to the upper tool body section. The tilt angle between the lower tool body section and the upper tool body section is measured at 124 at a first angular position (e.g., when the tilt angle is oriented at a first rotational position such as high side, low side, left side, or right side of the wellbore). The tilt angle between the lower tool body section and the upper tool body section is then measured at 126 when the tilt angle is rotated to a second angular position (e.g., 180 degrees offset from the first angular position). These tilt angles may be measured, for example, using strain gauges deployed in (or near to) the universal joint. The tilt angles are processed at 128 to compute an average (mean) of the two which is in turn processed at 130 to compute the dogleg severity.

Figure 6:
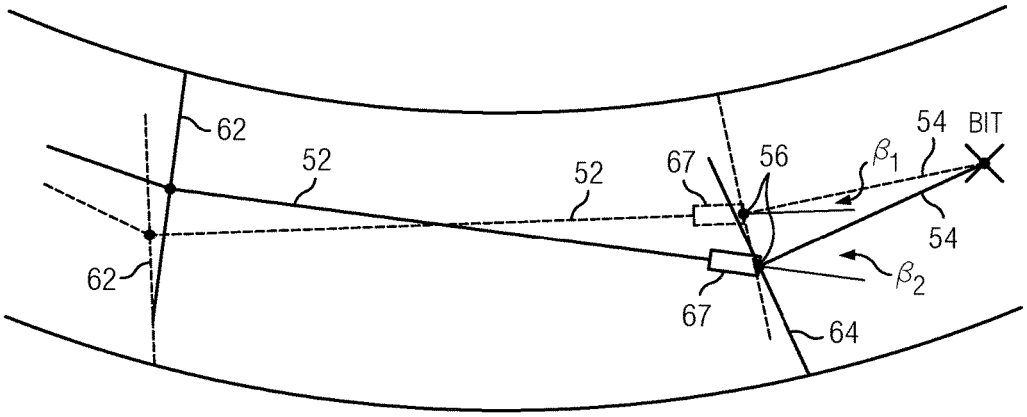
FIG. 6 depicts a schematic of a downhole tool deployed in a deviated wellbore suitable for implementing the method depicted on FIG. 5.

FIG. 6 depicts a schematic of a downhole tool deployed in a deviated wellbore suitable for implementing the method depicted on FIG. 5. It will be understood that similar to FIG. 4, the depiction on FIG. 6 is highly schematized and not drawn to scale. For example, the upper and lower stabilizers 62 and 64 and upper and lower tool body sections 52 and 54 are depicted as stick figures in wellbore 40. Moreover, the dogleg severity (curvature) of wellbore 40 is highly exaggerated for illustration purposes. The solid lined depiction shows the tool when the tilt angle is rotated to a first angular position (at 124) in the direction of the wellbore curvature and the dashed line depiction shows the tool when the tilt angle is rotated to a second angular position (at 126) opposed to the wellbore curvature (180 degrees offset from the wellbore curvature).

With continued reference to FIG. 6, tilting the lower tool body section 54 with respect to the upper tool body section 52 may cause the upper and lower stabilizers 62 and 64 to contact the wellbore wall on the opposite sides of the wellbore. As the tilt angle rotates around the wellbore (e.g., via rotating the force direction in the pistons), the contact points of the upper and lower stabilizers also rotate around the wellbore (yet continue to contact the wellbore wall on opposite sides of the wellbore). Owing to the clearance between the lower stabilizer 64 and the wellbore wall (i.e., since the lower stabilizer is slightly under gauge) rotation of the tilt angle causes a change in the magnitude of the tilt angle (the tilt angles are denoted as $\beta_1$ and $\beta_2$ in FIG. 6). In the depicted embodiment, deflection of the lower tool body section 54 in the direction of the curvature (the solid lines) increases the magnitude of the tilt angle while deflection in the opposite direction of the curvature of the hole (the dashed lines) decreases the magnitude of the tilt angle. Taking an average of these two tilt angles ($\beta_1$ and $\beta_2$) gives the tilt angle equivalent for a full gauge stabilizer in which the universal joint is centered in the wellbore.

As described above with respect to FIG. 5, the average tilt angle (e.g., $\gamma=(\beta_1+\beta_2)/2$) may be processed to obtain the dogleg severity (the curvature) of the wellbore. For example, the average angle may be processed to define three points along the axis of the wellbore. These points may be defined in substantially any coordinate system (the disclosed embodiments are not limited in this regard). For example, a two-dimensional coordinate system may be defined in which the center of the wellbore at the upper stabilizer is defined as being at the origin (0, 0). The center of the wellbore at the lower stabilizer may then be defined as being horizontally offset from the center of the upper stabilizer by a distance L (the axial separation distance between the stabilizers) at (L, 0). The center of the wellbore at the drill bit may then be defined as being located at (L+B cos γ, B sin γ), where B represents the axial separation distance between the lower stabilizer and the drill bit and γ represents the average tilt angle as indicated above.

The dogleg severity may then be computed, for example, by fitting a circle to the three points and computing the radius of the circle (the radius giving the radius of curvature of the three points). Those of ordinary skill will readily appreciate that there are many suitable ways to determine the equation of a circle that passes through three defined points. For example, the coordinates of the points may be substituted into the general form of a circle to solve for the coefficients using various numerical methods (the general form of the circle being: $x^2+y^2+Dx+Ey+F=0$).

Alternatively, one may use the center radius form of the circle and the fact that each point on a circle is equidistant from the center. Using the three points defined above (0, 0), (L, 0), and (L+B cos γ, B sin γ), the following equality may be defined:

$$(0-a)^2+(0-b)^2=(L-a)^2+(0-b)^2=(L+B\cos\gamma-a)^2+(B\sin\gamma-b)^2 \tag{3}$$

where L, B, and γ are as defined above and the center of the circle that includes the three points is given as (a, b). Solving Equation 3 for a and b enables the center of the circle to be expressed in terms of L, B, and γ, for example, as follows:

$$(a, b)=\left(\frac{L}{2}, \frac{L\cos\gamma+B}{2\sin\gamma}\right)\approx\left(\frac{L}{2}, \frac{L+B}{2\sin\gamma}\right) \tag{4}$$

The radius of the circle r (and therefore the radius of curvature) is defined as the distance between any one of the three points defined above and the center of the circle (e.g., as in Equation 4) and may be expressed mathematically, for example, as follows:

$$r=\sqrt{a^2+b^2}=\sqrt{\left(\frac{L}{2}\right)^2+\left(\frac{L\cos\gamma+B}{2\sin\gamma}\right)^2}\approx\frac{L+B}{2\sin\gamma} \tag{5}$$

The dogleg severity DLS may be expressed in terms of the radius in conventional wellbore units of degrees per 100 feet of wellbore measured depth, for example, as follows:

$$DLS=\frac{18000}{\pi\cdot r}\approx\frac{36000\cdot\sin\gamma}{\pi(L+B)} \tag{6}$$

It will be understood that the approximate relations given in Equations 4, 5, and 6 result from a small angle approximation in which it is assumed that the average tilt angle $\gamma$ is small (e.g., less than about 10 degrees such that $\cos\gamma \approx 1$). While this is generally a valid assumption (e.g., the PowerDrive Archer® tool depicted on FIG. 2 may incorporate a limit stop limiting the tilt angle to a maximum of a few degrees), the disclosed embodiments are not limited by any such assumptions and/or approximations.

Figure 7:
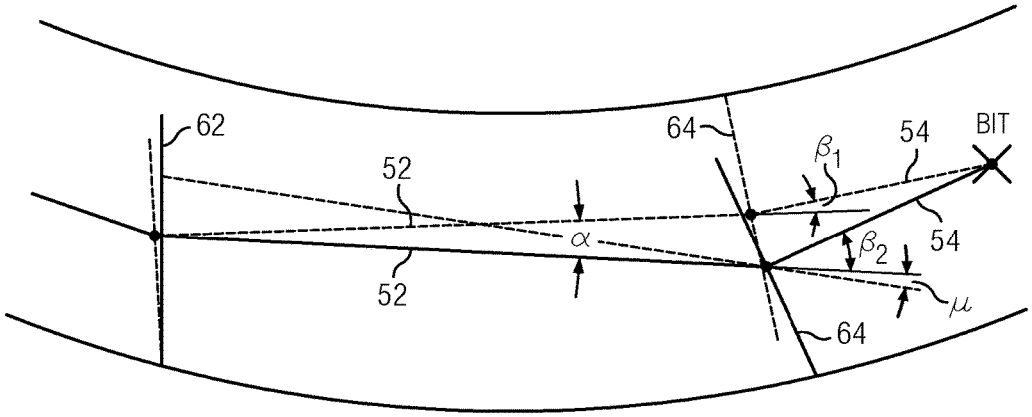
FIG. 7 depicts another schematic of a downhole tool deployed in a deviated wellbore suitable for implementing the method depicted on FIG. 5.

As described above, the upper and lower stabilizers are not always on opposite sides of the wellbore; for example, in a high dogleg section there may be sufficient bending moment in the upper tool body section 52 (depending on the stiffness of the BHA) such that the upper stabilizer may be constrained to remain on the outside of the curve (e.g., as depicted on FIG. 7). This may introduce a small error causing the DLS to be underestimated when using Equation 6 (since the drill collar is forced to the outside of the curve rather than being centralized). To compensate for this error, the aforementioned tilt angle measurements may alternatively and/or additionally be processed in combination with the above described measurements of the axial direction of the upper tool body section to compute the dogleg severity.

For example, it may be observed by comparing FIGS. 6 and 7 that constraining the upper stabilizer 62 on the outside of the curve reduces the magnitude of angle $\beta_2$ (while angle $\beta_1$ remains unchanged). This results in a corresponding underestimation of the dogleg severity, for example, when using Equation 6 in which DLS is proportional to $\sin\gamma$. The change in angle $\beta_2$ (denoted as $\mu$ in FIG. 7) may be computed from the wellbore gauge (diameter) measurement described above with respect to FIG. 4 and Equation 2, for example, as follows:

$$\mu = \sin^{-1}\left(\frac{L\sin(\alpha) + \phi_{stab1} - \phi_{stab2}}{L}\right) \tag{7}$$

The corrected average tilt angle $\gamma'$ may then be computed, for example, as follows:

$$\gamma' = \frac{\beta_1 + (\beta_2 + \mu)}{2} = \gamma + \frac{\mu}{2} \tag{8}$$

The dogleg severity DLS may then be computed by substituting $\gamma'$ as computed in Equation 8 into Equation 6 such that:

$$DLS \approx \frac{36000 \cdot \sin\gamma'}{\pi(L+B)} \approx \frac{36000 \cdot \left[\sin\gamma + \sin\left(\frac{\alpha}{2}\right) + \frac{\phi_{stab1} - \phi_{stab2}}{2L}\right]}{\pi(L+B)} \tag{9}$$

Note that when the diameters of the upper and lower stabilizers are equal (i.e., when $\phi_{stab1} = \phi_{stab2}$), as is often the case, Equation 7 reduces to $\mu = \alpha$ such that Equation 8 becomes $\gamma' = (\beta_1 + \beta_2 + \alpha)/2 = \gamma + \alpha/2$ and the dogleg severity given in Equation 9 becomes:

$$DLS \approx \frac{36000 \cdot [\sin\gamma + \sin(\alpha/2)]}{\pi(B+L)} \tag{10}$$

With continued reference to FIG. 7, an analytical expression for the dogleg severity may alternatively be derived using the procedure described above with respect to Equations 3-6. For example, the three points along the axis of the wellbore may be defined in terms of both the average tilt angle and the change (difference) in axial direction. Using the same two-dimensional coordinate system described above, the center of the upper stabilizer may be defined as being at the origin (0, 0). Assuming that the upper and lower stabilizers have equal diameters, the center of the lower stabilizer may be defined as being horizontally offset from the center of the upper stabilizer by a distance L (the axial separation distance between the stabilizers) and vertically offset from the center of the upper stabilizer by a distance $-L\sin(\alpha/2)$ at $(L, -L\sin(\alpha/2))$ where $\alpha$ represents the change in axial direction of the upper tool body section (see FIG. 7). The center of the drill bit may then be defined as being located at $(L+B\cos\gamma, B\sin\gamma - L\sin(\alpha/2))$, where, as defined above, B represents the axial separation distance between the lower stabilizer and the drill bit and $\gamma$ represents the average tilt angle.

The center of the circle (a, b) defined by the three points may then be expressed mathematically, for example, as follows (assuming that the average tilt angle $\gamma$ is small and that $\cos\gamma \approx 1$):

$$(a, b) \approx \left(\frac{L\sin\gamma + (B+2L)\sin(\alpha/2)}{2[\sin\gamma + \sin(\alpha/2)]}, \frac{B+L}{2[\sin\gamma + \sin(\alpha/2)]}\right) \tag{11}$$

At small tilt angles, the radius of the circle is approximately equal to b such that the dogleg severity DLS may be expressed in terms of the radius in conventional wellbore units of degrees per 100 feet of wellbore measured depth, for example, as given in Equation 10.

It will be understood that the measurements described herein (both the DLS and wellbore gauge measurements) may be made while drilling or rotating, while stopped (on or off bottom), while reaming up or down, or at multiple discrete points (similar to traditional surveys). The disclosed embodiments are not limited in these regards.

It will be further understood that while not shown in FIGS. 1 and 2, downhole measurement tools suitable for use with the disclosed embodiments generally include at least one electronic controller. Such a controller typically includes signal processing circuitry including a digital processor (a microprocessor), an analog to digital converter, and processor readable memory. The controller typically also includes processor-readable or computer-readable program code embodying logic, including instructions for computing downhole various parameters as described above, for example, with respect to Equations 1-11. One skilled in the art will also readily recognize some of the above mentioned equations may also be solved using hardware mechanisms (e.g., including analog or digital circuits).

A suitable controller typically includes a timer including, for example, an incrementing counter, a decrementing time-out counter, or a real-time clock. The controller may further include multiple data storage devices, various sensors, other controllable components, a power supply, and the like. The controller may also optionally communicate with other instruments in the drill string, such as telemetry systems that communicate with the surface or an EM (electro-magnetic) shorthop that enables the two-way communication across a downhole motor. It will be appreciated that the controller is not necessarily located in the downhole tool (e.g., downhole tool 50), but may be disposed elsewhere in the drill string in electronic communication therewith. Moreover, one skilled in the art will readily recognize that the multiple functions described above may be distributed among a number of electronic devices (controllers).

Although methods for estimating wellbore gauge and dogleg severity and certain advantages thereof have been described in detail, it should be understood that various changes, substitutions and alternations can be made herein without departing from the spirit and scope of the disclosure as defined by the appended claims.

What is claimed is:

1. A method for estimating wellbore dogleg severity in a downhole tool, the method comprising:

(a) deploying a downhole tool in a subterranean wellbore, the downhole tool including first and second tool body sections coupled to one another via a universal joint that enables relative tilting of the tool body sections, the downhole tool further including first and second axially spaced stabilizers deployed on at the corresponding first and second tool body sections;

(b) tilting the universal joint in a first cross-axial direction such that the second tool body section is tilted in a direction of wellbore curvature and measuring a magnitude of a first tilt angle of the universal joint;

(c) tilting the universal joint in a second cross-axial direction such that the second tool body section is tilted away from the wellbore curvature and measuring a magnitude of a second tilt angle of the universal joint; and (d) processing the magnitude of the first tilt angle measured in (b) and the magnitude of the second tilt angle measured in (c) to estimate the dogleg severity.

2. The method of claim 1, wherein the universal joint is tilted in the second cross-axial direction in (c) by rotating a direction of tilt from the first cross-axial direction to the second cross-axial direction.

3. The method of claim 1, wherein:

the tilting in (b) causes the first stabilizer to contact the wellbore on an inside wall of a curved section and the second stabilizer to contact the wellbore on an outside wall of the curved section; and the tilting in (c) causes the first stabilizer to contact the wellbore on an outside wall of the curved section and the second stabilizer to contact the wellbore on an inside wall of the curved section.

4. The method of claim 1, wherein the first stabilizer is deployed on the first tool body section and the second stabilizer is deployed on the second tool body section.

5. The method of claim 1, wherein the second cross-axial direction is diametrically opposed to the first cross-axial direction.

6. The method of claim 1, wherein the magnitudes of the first and second tilt angles are measured using strain gauges deployed in the universal joint.

7. The method of claim 1, wherein the processing in (d) further comprises:

processing the magnitudes of the first and second tilt angles to compute an average tilt angle; and (ii) processing the average tilt angle to compute the dogleg severity.

8. The method of claim 7, wherein the processing in (ii) further comprises:

(iia) processing the average tilt angle to define three points along an axis of the wellbore;

(iib) fitting a circle to the three points to obtain a radius of curvature; and (iic) processing the radius of curvature to compute the dogleg severity.

9. The method of claim 8, wherein the radius of curvature is computed in (iib) and the dogleg severity is computed in (iic) using the following mathematical equations:

$$r = \sqrt{\left(\frac{L}{2}\right)^2 + \left(\frac{L\cos\gamma + B}{2\sin\gamma}\right)^2} \approx \frac{L+B}{2\sin\gamma}$$

$$DLS = \frac{18000}{\pi \cdot r}$$

wherein r represents the radius of curvature, DLS represents the dogleg severity, L represents an axial length of the first tool body section, B represents an axial length of the second tool body section, and γ represents the average tilt angle.

10. The method of claim 7, wherein the dogleg severity is computed using the following mathematical equation:

$$DLS = \frac{36000 \cdot \sin\gamma}{\pi(L+B)}$$

wherein DLS represents the dogleg severity, L represents an axial length of the first tool body section, B represents an axial length of the second tool body section, and γ represents the average tilt angle.

11. The method of claim 1, wherein (b) further comprises measuring a first axial direction of the first tool body section when the universal joint is tilted in the first cross-axial direction;

(c) further comprises measuring a second axial direction of the first tool body section when the universal joint is tilted in the second cross-axial direction; and (d) further comprises processing the first tilt angle and the first axial direction measured in (b) and the second tilt angle and the second axial direction measured in (c) to estimate the dogleg severity.

12. The method of claim 11, wherein the processing in (d) further comprises:

(i) processing the magnitudes of the first and second tilt angles to compute an average tilt angle and the first and second axial directions to compute a change in axial direction; and (ii) processing the average tilt angle and the change in axial direction to compute the dogleg severity.

13. The method of claim 12, wherein the dogleg severity is computed using one of the following mathematical equations:

$$DLS = \frac{36000 \cdot \left[\sin\gamma + \sin\left(\frac{\alpha}{2}\right) + \frac{\phi_{stab1} - \phi_{stab2}}{2L}\right]}{\pi(L+B)}$$

$$DLS \approx \frac{36000 \cdot [\sin\gamma + \sin(\alpha/2)]}{\pi(B+L)}$$

wherein DLS represents the dogleg severity, L represents an axial length of the first tool body section, B represents an axial length of the second tool body section, γ represents the average tilt angle, α represents the change in axial direction, Stab1 represents a gauge of the first stabilizer, and Stab2 represents a gauge of the second stabilizer.

14. A method for estimating wellbore dogleg severity in a downhole tool, the method comprising:

(a) deploying a downhole tool in a subterranean wellbore, the downhole tool including first and second axially spaced stabilizers deployed on at least one tool body section coupled to a universal joint;

(b) measuring a magnitude of a first tilt angle of the universal joint when the universal joint is tilted in a first cross-axial direction;

(c) measuring a magnitude of a second tilt angle of the universal joint when the universal joint is tilted in a second cross-axial direction, wherein the second cross-axial direction is diametrically opposed to the first cross-axial direction; and (d) processing the first tilt angle measured in (b) and the second tilt angle measured in (c) to estimate the dogleg severity.

15. The method of claim 14, wherein the first stabilizer is deployed on a first tool body section of the at least one tool body section and the second stabilizer is deployed on a second tool body section of the at least one tool body section.

16. The method of claim 14, wherein the magnitudes of the first and second tilt angles are measured using strain gauges deployed in the universal joint.

17. The method of claim 14, wherein the processing in (d) further comprises:

(i) processing the magnitudes of the first and second tilt angles to compute an average tilt angle; and (ii) processing the average tilt angle to compute the dogleg severity.

18. The method of claim 17, wherein the processing in (ii) further comprises:

(iia) processing the average tilt angle to define three points along an axis of the wellbore;

(iib) fitting a circle to the three points to obtain a radius of curvature; and (iic) processing the radius of curvature to compute the dogleg severity.

19. The method of claim 14, wherein (b) further comprises measuring a first axial direction of a first tool body section of the at least one tool body section when the universal joint is tilted in the first cross-axial direction;

(c) further comprises measuring a second axial direction of the first tool body section when the universal joint is tilted in the second cross-axial direction; and (d) further comprises processing the first tilt angle and the first axial direction measured in (b) and the second tilt angle and the second axial direction measured in (c) to estimate the dogleg severity.

20. The method of claim 19, wherein the processing in (d) further comprises:

(i) processing the magnitudes of the first and second tilt angles to compute an average tilt angle and the first and second axial directions to compute a change in axial direction; and (ii) processing the average tilt angle and the change in axial direction to compute the dogleg severity.

* * * * *